US012024896B2

(12) United States Patent
Neil et al.

(10) Patent No.: US 12,024,896 B2
(45) Date of Patent: Jul. 2, 2024

(54) GRIPPING CORNERBEAD

(71) Applicant: Noll/Norwesco LLC, Fife, WA (US)

(72) Inventors: John Neil, Boca Raton, FL (US); Michael Starozhitsky, Long Grove, IL (US); David Starr, Vashon, WA (US)

( * ) Notice: Subject to any disclaimer, the term of this patent is extended or adjusted under 35 U.S.C. 154(b) by 0 days.

(21) Appl. No.: 17/860,543

(22) Filed: Jul. 8, 2022

(65) Prior Publication Data

US 2023/0046179 A1 Feb. 16, 2023

Related U.S. Application Data

(60) Provisional application No. 63/232,242, filed on Aug. 12, 2021.

(51) Int. Cl.
*E04F 13/06* (2006.01)

(52) U.S. Cl.
CPC ..... *E04F 13/06* (2013.01); *E04F 2013/063* (2013.01)

(58) Field of Classification Search
CPC ... E04F 13/06; E04F 2013/063; E04F 13/068; E04F 13/061; F16B 15/0038; F16B 15/003; F16B 15/0046
See application file for complete search history.

(56) References Cited

U.S. PATENT DOCUMENTS 594,555 A * 11/1897 Preston ..... F16B 15/0046 403/283
778,809 A * 12/1904 Stokes ..... F16B 15/0046 411/467
1,791,337 A * 2/1931 Wendell ..... F16B 15/0038 411/921
2,117,308 A * 5/1938 Frey ..... F16B 15/0046 411/921
2,433,914 A * 1/1948 Lang ..... F16B 15/08 206/343
2,826,352 A * 3/1958 Holtkamp ..... B65D 5/448 217/70
4,460,420 A * 7/1984 Estrada ..... E04G 23/0203 52/514
4,679,367 A * 7/1987 Geisthardt ..... F16B 15/0046 144/353
5,778,617 A * 7/1998 Free ..... E04F 13/06 52/255
6,171,043 B1 * 1/2001 Williams ..... F16B 15/0046 52/712
6,295,776 B1 10/2001 Kunz
6,438,914 B1 * 8/2002 Robertson ..... E04F 13/06 52/287.1
6,539,680 B2 4/2003 Kunz
6,691,476 B1 2/2004 Kunz
6,722,092 B2 4/2004 Kunz
(Continued)

FOREIGN PATENT DOCUMENTS

DE 102014105391 A1 * 10/2015 ..... E04C 3/07
GB 2585937 A * 1/2021 ..... E04F 13/06

*Primary Examiner* — Theodore V Adamos
(74) *Attorney, Agent, or Firm* — Lippes Mathias LLP

(57) ABSTRACT

A cornerbead for drywall construction according to one embodiment having an elongated strip bent at a substantially right angle to form an upper portion having an upper edge and a lower portion having a lower edge; and at least two triangular cut out projections along the upper edge and at least two triangular cut out projections along the lower edge.

4 Claims, 2 Drawing Sheets

(56) References Cited

U.S. PATENT DOCUMENTS

| | | | | |
|---|---|---|---|---|
| 7,013,610 | B2 | 3/2006 | Kunz | |
| 7,383,668 | B1 | 6/2008 | Kunz | |
| 9,222,266 | B1 * | 12/2015 | Conboy | E04F 13/06 |
| 2002/0073638 | A1 | 6/2002 | Kunz | |
| 2015/0147135 | A1 * | 5/2015 | Koch | F16B 37/048 411/353 |

* cited by examiner

GRIPPING CORNERBEAD

This application claims priority to provisional patent application 63/232,242 filed Aug. 12, 2021 and hereby incorporates that application by reference in its entirety.

FIELD OF INVENTION

This invention relates generally to drywall construction and, in particular, a gripping cornerbead.

BACKGROUND

Traditional cornerbead is structural strip which is fastened to corners where edges of drywall meet forming a surface transition between two different planar wall surfaces. Once installed the peak of the cornerbead trim provides a straight smooth guide for tradesman to float trowel over leveling drywall mud blending into continuous wall surface with a strong corner backing structure resisting dings, and chipping. The method of attaching the trim to the corner has evolved over time from nails and screws to staples and drywall mud.

Drywall is formed of sheets of plaster which are enclosed in an outer wrapping of heavy construction paper. When the drywall is attached to a wall, the joint between adjacent sheets of drywall is usually covered by a paper tape extending along the joint. The tape is then covered with wet plaster or mud. The plaster is smoothed along the edges of the tape to conceal the tape edges and form a smooth surface. The corners of the drywall often require cutting which can expose the plaster between the heavy paper sheets. The exposed plaster tends to chip or crumble unless these edges are protected.

BRIEF DESCRIPTION OF THE INVENTION

According to one aspect of the present invention, a cornerbead for drywall construction is provided having an elongated strip bent at a substantially right angle to form an upper portion and a lower portion and at least three raised triangular portions provided in a circle to form at least one substantially circular projection.

According to another aspect of the present invention, a cornerbead for drywall construction is provided having an elongated strip bent at a substantially right angle to form an upper portion having an upper edge and a lower portion having a lower edge; and at least two triangular cut out projections along the upper edge and at least two triangular cut out projections along the lower edge.

According to another aspect of the present invention, a cornerbead for drywall construction is provided having an elongated strip bent having an upper edge and a lower edge; and at least two triangular cut out projections along the upper edge and at least two triangular cut out projections along the lower edge.

DETAILED DESCRIPTION OF THE INVENTION

In the following detailed description, numerous specific details are set forth in order to provide a thorough understanding of the disclosure. However, it will be understood by those skilled in the art that the present disclosure may be practiced without these specific details. In other instances, well-known methods, procedures and components have not been described in detail so as not to obscure the present disclosure.

Figure 1:
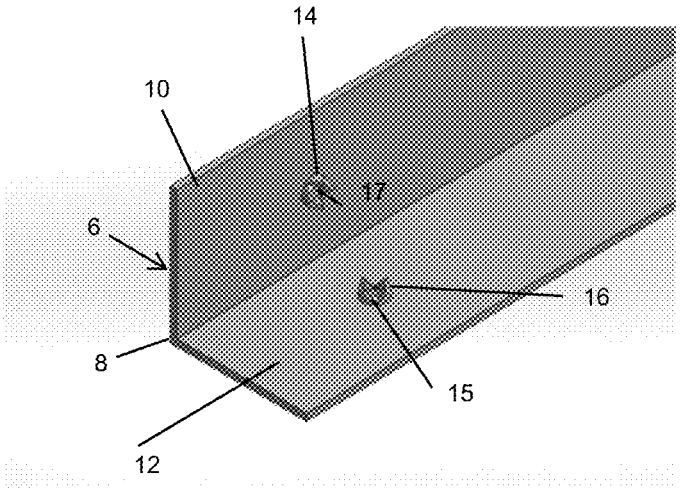
FIG. 1 depicts a cornerbead according to the present invention.
Figure 7:
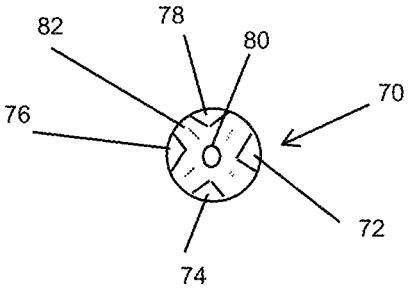
FIG. 7 depicts a circular projection according to the present invention.

As depicted in FIGS. 1 and 7 (depicting a top view of the substantially circular projection), a cornerbead for drywall construction is provided comprising: an elongated strip bent (6) at a substantially right angle (8) to form an upper portion (10) and a lower portion (12); at least three raised triangular portions (72, 74, 76 and 78) provided in a circle to form at least one substantially circular projection (16, 70). There may be an opening (15, 80) and an indentation (17) in the center of each of the substantially circular projections. FIG. 7 has indentation lines (82) intended to depict the side walls may be indented and slope downwards toward the opening in the center. FIG. 1 depicts four raised triangular portions provided in a circle to form the substantially circular projection. As shown, there is a first substantially circular projection (14) on the upper portion (10) and a second substantially circular projection (16) on the lower portion (12). The elongated strip may be made of metal, such as galvanized steel or stainless steel. The elongated strip and related parts may also be made of plastic, vinyl, or rigid composite. It is noted that the terms upper portion and lower portion are used to refer to portions of the elongated strip and not their orientation as installed. The strip may be turned vertically, horizontally or in any manner during installation.

Figure 2:
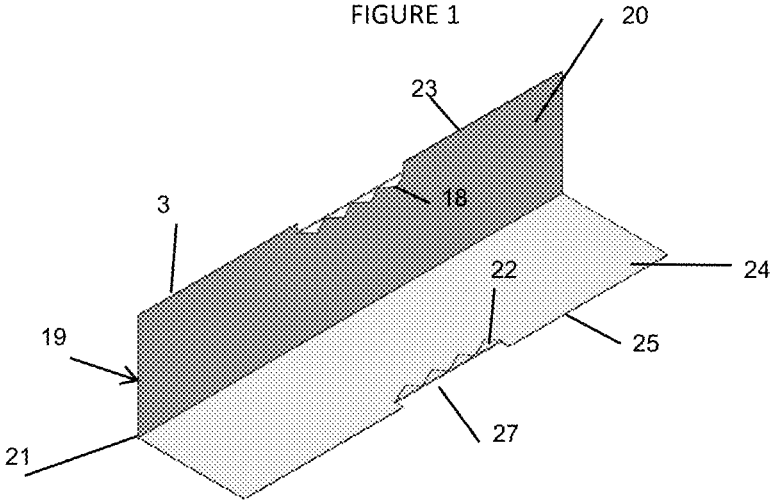
FIG. 2 depicts a cornerbead according to the present invention.

As depicted in FIG. 2, a cornerbead for drywall construction is provided, comprising: an elongated strip (19) bent at a substantially right angle (21) to form an upper portion (20) having an upper edge (23) and a lower portion (24) having a lower edge (25); at least two triangular cut out projections (18) along the upper edge (23) and at least two triangular cut out projections (22) along the lower edge (25). As depicted in FIG. 2, there may be a rectangular cut out (27) and the portion bent with triangular portions removed leaving triangular cut out projections. According to the embodiment shown there are four triangular cut out projections, but there may be any number of projections. The at least two triangular cut out projections along the upper edge (18) and the at least two triangular cut out projections along the lower edge may be at a center portion of the elongated strip.

Figure 3:
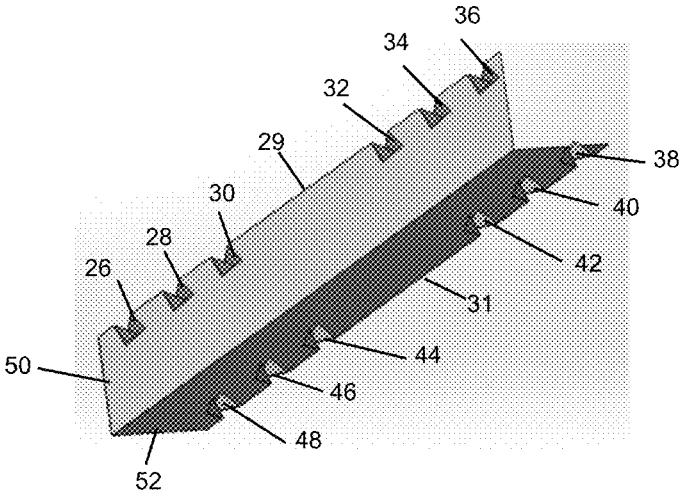
FIG. 3 depicts a cornerbead according to the present invention.

As depicted in FIG. 3, wherein the at least two triangular cut out projections (26, 28, 30, 32, 34 and 36) along the upper edge (29) and the at least two triangular cut out projections (38, 40, 42, 44, 46 and 48) along the lower edge (31) are formed by a single center cut and two opposed bends on either side of the single center cut to form an opposing triangle cut.

Figure 5:
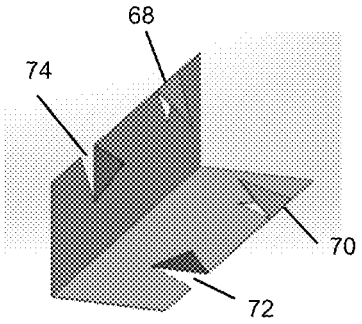
FIG. 5 depicts a cornerbead according to the present invention.
Figure 6:
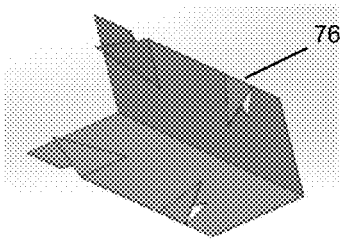
FIG. 6 depicts a cornerbead according to the present invention.

As depicted in FIGS. 5 and 6, the at least two triangular cut out projections (74, 68) along the upper edge and the at least two triangular cut out projections (70, 72) along the lower edge are formed by a single cut and a single bend.

Figure 4:
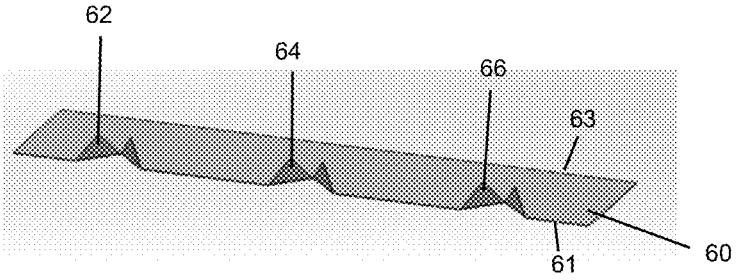
FIG. 4 depicts a cornerbead according to the present invention.

As depicted in FIG. 4, a cornerbead for drywall construction is provided having an elongated strip (60) having a first edge (61) and a second edge (63); at least two triangular cut out projections (62, 64 and 66) along at least one of the first edge (61) and the second edge (63). The at least two triangular cut out projections may be at a center portion of the elongated strip or spread out along an edge. The at least two triangular cut out projections may be formed by a single center cut and two opposed bends on either side of the single center cut to form an opposing triangle cut (62, 64, 66). The at least two triangular cut out projections may also be formed by a single cut and a single bend (as shown in FIG. 5). As shown in FIG. 6, the triangular cut out projection (76) may be formed by a triangular cut out that is still attached at the corners of the base of the triangle.

As part of product manufacturing process, additional features may be installed onto the back (or wall side) of cornerbead base material which mechanically adheres or attaches to the wall via deformed projections and/or adhesive. For configuration which includes spikes or deformed features the trims could be installed with tapping mallet, or a V-shaped roller that pushes the features through the surface paper on drywall and hooks or locks trim onto corner. The spring tension resulting from the shape of the cornerbead trim can help hold tension against the perforated edge of the drywall paper surface. Adhesive type could be pre applied or site applied alternative to mud compound significantly reducing the installation time waiting for water-based drywall mud to cure. Adhesive compound could be chemical, hot melt, RTV, or UV cure single part or two-part systems. The adhesive would typically be a thin layer applied to the backside (3) of the elongated strip. It is noted that the backside is not visible in FIG. 2, it is the underneath backside of the elongated strip.

The described embodiments of the invention are intended to be exemplary and numerous variations and modifications will be apparent to those skilled in the art. All such variations and modifications are intended to be within the scope of the present invention as defined in the appended claims. Although the present invention has been described and illustrated in detail, it is to be clearly understood that the same is by way of illustration and example only, and is not to be taken by way of limitation. It is appreciated that various features of the invention which are, for clarity, described in the context of separate embodiments may also be provided in combination in a single embodiment. Conversely, various features of the invention which are, for brevity, described in the context of a single embodiment may also be provided separately or in any suitable combination. It is appreciated that the particular embodiment described in the specification is intended only to provide an extremely detailed disclosure of the present invention and is not intended to be limiting.

Modifications of the above disclosed apparatus and methods which fall within the scope of the invention will be readily apparent to those of ordinary skill in the art. Accordingly, while the present invention has been disclosed in connection with exemplary embodiments thereof, it should be understood that other embodiments may fall within the spirit and scope of the invention, as defined by the following claims.

What is claimed:

1. A cornerbead for drywall construction, comprising:

an elongated strip bent at a substantially right angle to form an upper portion having an upper edge and a lower portion having a lower edge;

at least two triangular cut out projections adjacent to each other and forming a single opening along the upper edge and at least two triangular cut out projections adjacent to each other and forming a single opening along the lower edge;

wherein the at least two triangular cut out projections of the upper edge and/or the lower edge are formed by a single cut extending substantially perpendicular to the respective edge and opposed bends extending oblique to the respective edge and substantially symmetrical about the respective sinqle cut to form the respective sinqle opening; and wherein adhesive is on a back side of said elongated strip.

2. A cornerbead for drywall construction as in claim 1, wherein the at least two triangular cut out projections along the upper edge and the at least two triangular cut out projections along the lower edge are at a center portion of the elongated strip.

3. A cornerbead for drywall construction as in claim 1, wherein the elongated strip is metal, plastic, vinyl or rigid composite material.

4. A cornerbead for drywall construction as in claim 3, wherein the metal is galvanized steel or stainless steel.

* * * * *